US005193758A

United States Patent [19]

Laager et al.

[11] Patent Number: 5,193,758

[45] Date of Patent: Mar. 16, 1993

[54] APPARATUS FOR HOLDING AND FOR UNWINDING COILS

[75] Inventors: Georg Laager, Turbenthal; Ingomar Summerauer, Arbon, both of Switzerland

[73] Assignee: Bruderer AG, Switzerland

[21] Appl. No.: 613,778

[22] PCT Filed: Feb. 26, 1990

[86] PCT No.: PCT/CH90/00044

§ 371 Date: Oct. 29, 1990

§ 102(e) Date: Oct. 29, 1990

[87] PCT Pub. No.: WO90/09945

PCT Pub. Date: Sep. 7, 1990

[30] Foreign Application Priority Data

Feb. 27, 1989 [CH] Switzerland ..... 711/89

[51] Int. Cl.[5] ..... B65H 16/02

[52] U.S. Cl. ..... 242/55; 242/105; 242/129

[58] Field of Search ..... 242/55, 58.6, 68, 68.3, 242/78.6, 78.7, 78.8, 68.7, 79, 83, 105, 129

[56] References Cited

U.S. PATENT DOCUMENTS

| | | | |
|---|---|---|---|
| 3,162,394 | 12/1964 | Culpepper et al. | 242/78.6 |
| 3,512,728 | 5/1970 | Johnson | 242/78.6 |
| 3,561,691 | 2/1971 | Nichols et al. | 242/55 |
| 3,568,945 | 3/1971 | Hepner | 242/68.3 |
| 3,656,700 | 4/1972 | Gauvin | 242/68.3 X |
| 4,863,112 | 9/1989 | Summerauer et al. | 242/78.8 |

*Primary Examiner*—John M. Jillions

*Attorney, Agent, or Firm*—Ostrolenk, Faber, Gerb & Soffen

[57] ABSTRACT

A receiving device consists of a base element and a reinforcing arrangement. It is designed to receive a coil and serves both for storage and to facilitate manipulation when a coil is being unwound. The base element is provided with openings through which supporting elements can be inserted in order to raise the coil, for example during unwinding, from the base element of the receiving device. The supporting elements may be rollers or a central mandrel, which are arranged on a handling station.

34 Claims, 6 Drawing Sheets

APPARATUS FOR HOLDING AND FOR UNWINDING COILS

BACKGROUND OF THE INVENTION

The invention relates to an apparatus for holding and for unwinding coils of tape-like or wire-like material.

Cassettes and manipulators for coils of tape-like or wire-like material are known and commonly used in a very wide range of embodiments. Known coil cassettes are generally designed for "just-in-time" production, i.e. a coil is stored in the cassette and fed to a processing machine, for example a press; there, part of the wound tape or wire is pulled off. The cassette with the partially used or unwound coil is then returned to a storage rack. Such coils and storage methods for coils are disclosed, for example, in the following publications: German Auslegeschrift 2,842,448, German Offenlegungsschrift 3,435,215, 3,417,130 and 2,639,427 and EP-A1-267357.

Since the known cassettes are designed having unwinding and storage apparatuses, for example for vertical storage and withdrawal of the tape material, they must be designed to be stable enough to perform the task. The space requirement for such cassettes is correspondingly large and the cassettes are complicated and expensive to produce. Furthermore, the cassettes generally follow the outer configuration of the coil, i.e. they are circular and correspondingly difficult to manipulate and to store.

SUMMARY OF THE INVENTION

It is the object of the invention to improve the disadvantages to date, in particular, therefore, to provide an economical, simple system which improves the possibilities for storing and handling coils, and in particular facilitates automation of storage and of handling. According to the invention, this is achieved by an apparatus having the features described herein.

Advantageous further embodiments of the invention are described as well.

By the use of a trough-like base element, open at the top, for holding the coils, various surprising advantages can be obtained in combination: on the one hand, the coil can be stored in the trough or removed from the trough in a simple manner. Furthermore, the coil can be lifted for unwinding in the trough and can be stored in a separate coil or storage arrangement during withdrawal of the tape material, without the coil having to be removed from the base element.

By means of a stiffening arrangement in the edge region of the base element, it is also possible to achieve sufficient static strength in a simple manner. This allows, for example, the holding apparatus to be moved on a rail-like support which engages the stiffening arrangement on both sides. Thus, storage can be effected in a space-saving manner, for example in a rack having support rails arranged vertically one on top of the other.

If the stiffening arrangement is in the form of a frame, tension belts can be fastened to said frame, preferably diagonally and at the surface of the frame, said belts serving to hold the coil. This ensures an extremely low weight in conjunction with adequate stability for the cassette. To allow the coil to be level on the slightly sagging tension belts and to ensure that the force applied to the tension belts by the coil weight is as uniform as possible, support elements are preferably provided. The coil itself or a coil support disk comes to rest on its level surface, while the underneath of this support element, which in particular is in the form of a U-profile, is appropriately adapted to the sag of the tension belts. This can also be achieved by appropriately shaped insert wedges fitted into the U-profile of the support elements.

Particularly this last-mentioned embodiment has the great advantage that the holding apparatus can be used in the same way for coils having different tape widths.

It is expedient if a centering means for the coil is provided in the base element. Centering means can advantageously be formed, for example, in such a way that it contributes to the stiffening of the base element. This is particularly simple if the centering means is in the form of, for example, a raised edge or a bead.

If the coil rests on a coil support disk, the centering means is provided in the center of said disk, which preferably has a raised, bead-like edge, by means of which it engages the internal diameter of the coil and permits a spindle to be centered and inserted, for unwinding the coil.

However, the centering means can not only be provided on the holding apparatus itself but also introduced into said apparatus, for example for unwinding, through an orifice in the base or from above, in such a way that the coil is supported in the center during unwinding. In this way, it is possible to achieve a situation where the holding apparatus itself is not subjected to a load by the tensile forces occurring during unwinding or withdrawal of the tape-like material. For this purpose, the base element of the center of the tension belts and of the support element is provided in a simple manner with an orifice through which a spindle can be introduced so that the spindle rests at the center of the coil and supports the latter during withdrawal or unwinding, which is of interest particularly in the vertical unwinding of the coil.

The centering means for the coil may thus have a variety of forms and may be a spindle, a pulley, a bead or a bush in the base element or the coil support disk, or may be in the form of a spindle engaging therein or simply engaging a central orifice, or may be a combination of two or more of the state elements.

Particularly great rigidity of the base element is achieved, in a simple manner, by the embodiment of the stiffening arrangement and as a laterally raised edge of the base element and/or as a bead stiffening in the base region.

The base element can be relieved in an advantageously simple manner from all tensile and bearing forces if it is provided with orifices through which suitable elements for lifting the coil engage the coil or its support disk during insertion, removal or unwinding. This can be achieved in a particularly expedient manner if the orifices are three or four radial slots through which rollers or pulleys can be introduced from below. In the variant having the tension belts fastened to the frame, this penetration of rollers or pulleys takes place even more simply, said rollers or pulleys penetrating into the free spaced between the tension belts.

As mentioned above, the retaining element provided may also be a spindle which passes through an orifice in the center of the base element, may spread out within the internal diameter of the coil and thus lifts the coil and supports it rotatably.

To ensure the spindle is inserted as easily as possible into the center of the centering means, this centering means should advantageously be radially displaceable, this displaceability being relative to the base element of the cassette or to the coil support disk.

If the stiffening arrangement is in the form of a laterally raised edge, a slot or, in order to remain independent of the tape width of the coil, a gap open at the top for passage of the tape-like or wire-like material is advantageously provided in the side wall of the base element.

If, on the other hand, the coil rests with its coil support disk on support elements inverted over the tension belts, to prevent the generally relatively stiff coil tapes from springing up a securing bracket should be mounted, said bracket preferably being arranged around the outer diameter of the coil and in turn having a slot or open gap for passage of the coil tape.

However, securing brackets are advantageous even in the case of a coil present in the trough-like base element without a support disk, said brackets preventing jamming of the coil tape between the orifices of the base element and the rollers or pulleys.

To ensure that the particular beginning of the tape of a coil is available in a defined length and at a defined position, a tape clamping apparatus should be provided. For this purpose, the tape is clamped between two clamping jaws which are moved relative to one another by means of a toggle lever system which is preferably hinged to the stiffening arrangement. When the coil is lifted, this tape clamping apparatus must be lifted as well in order to avoid deformation of the coil tape. This can be achieved in a simple manner if it is mounted on the stiffening arrangement. It can then be raised together with the coil by means of separate brackets.

As described above, rollers or pulleys can be used for lifting and unwinding the coil. In the simplest case, these are in the form of cylindrical rollers, but they have the disadvantage that the rotational speeds, which are very different especially in the case of large coil diameters, cannot be compensated for. Instead, it is possible to provide conically shaped rollers which, however, should be overhung or, preferably, individual, independently movable, disk-shaped pulleys on a common axle.

Although the holding apparatus according to the invention is very particularly advantageous for horizontal storage and manipulation, applications where the holding apparatus, together with the coil, is vertically oriented and pushed onto a horizontal spindle are also possible. A controlled hold-down means which supports the coil during orientation, manipulation and processing may be used.

According to the invention, the entire storage and manipulation process is improved in an optimally simple manner and at the same time the effort involved in constructing the holding apparatus is dramatically reduced. The base element used can be efficiently produced from metal by the bending and drawing welding technique or by combined production processes; it may also be produced from plastic, for example by the injection molding technique.

BRIEF DESCRIPTION OF THE DRAWINGS

The invention is described in detail below with reference to drawings, by way of example.

DETAILED DESCRIPTION

Figure 1:
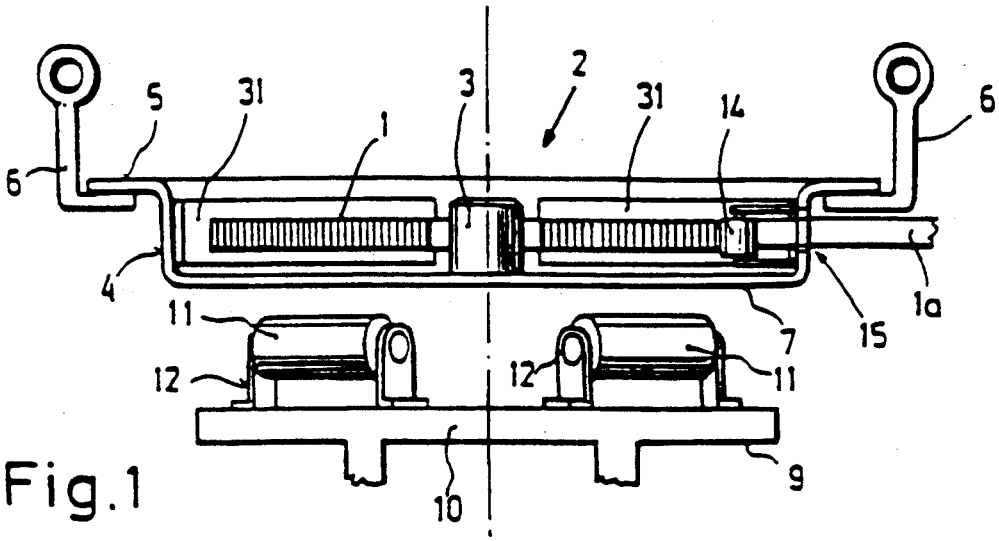
FIG. 1 shows a schematic representation of a holding and unwinding apparatus according to the invention, having a coil above a handling station.
Figure 2:
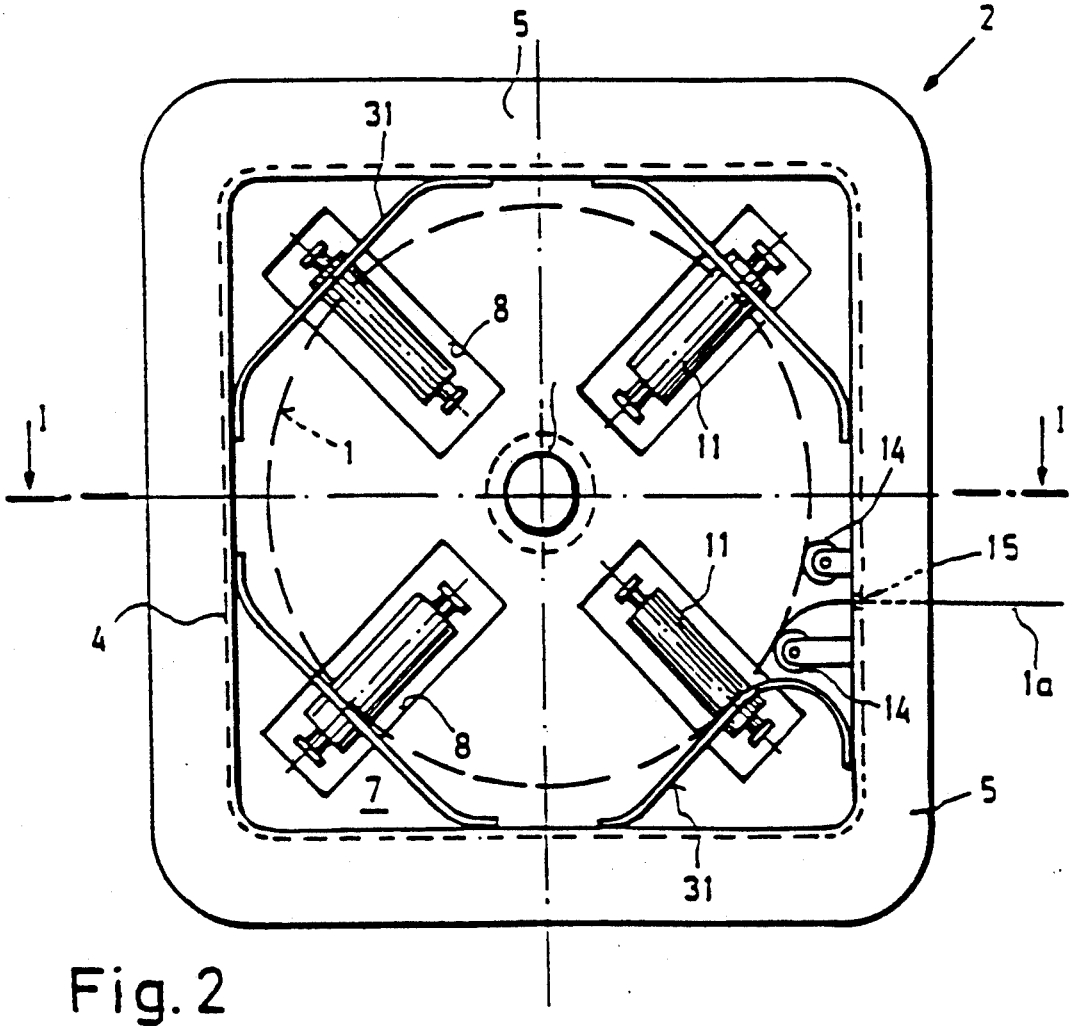
FIG. 2 shows a plan view of the apparatus according to FIG. 1.
Figure 3:
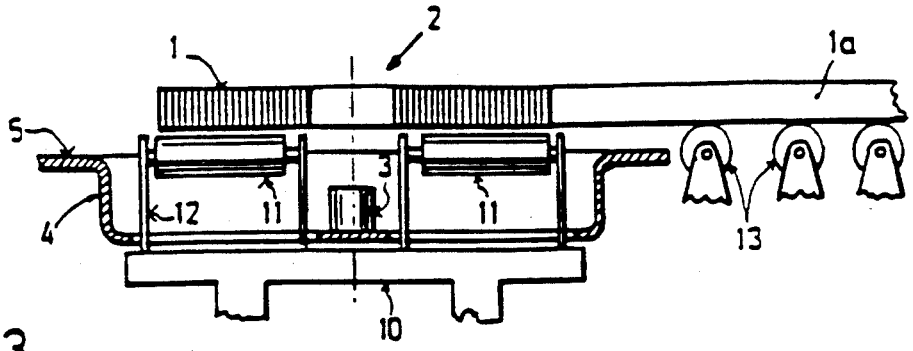
FIG. 3 shows the apparatus according to FIG. 1 in the lowered state on the handling station.

In FIG. 1 and 2, a coil 1 is stored in a holding and unwinding apparatus 2 which is provided with a raised centering spindle 3 in the center and with a stiffening arrangement 4 at its outer edge. The holding apparatus 2 is molded, so that the stiffening arrangement 4 is in the form of a raised edge 5 produced by the deep drawing process. As shown schematically in FIG. 1, the holding apparatus 2 can be held laterally and manipulated by a support means, for example grippers with rails 6. This is possible without a manipulator directly engaging the coil 1 and damaging it. Furthermore, the rectangular design of the holding apparatus 2 ensures that the apparatus 2 can be placed or moved on parallel rails or supports of a rack. The coil 1 rests on base element 7, which is produced as a single piece with the edge 5. Base element 7 has orifices 8 which run radially from the spindle 3 outward. FIG. 1 to 3 show the cooperation of the holding apparatus 2 with a handling station 9. The handling station 9 has a table 10 on which rollers or pulleys 11 are mounted by means of bearing brackets 12 and project upward. The rollers 11 and the orifices 8 are arranged with respect to one another in such a way that, when the holding apparatus 2 is lowered, the rollers 11 and the brackets 12 pass through the orifices in the base element 7 and lift the coil 1, as shown in FIG. 3.

Of course, the "placing" of the coil on the rollers 11 can be achieved both by virtue of the fact that the holding apparatus 2 is lowered over the table 10 by means of rails 6, and by correspondingly lifting the table 10 relative to the base element 7. Such adaptations are familiar to the skilled worker.

The coil 1 can be lifted by the rollers 11 to the extent shown in FIG. 3. The coil can then be dispensed, for example via conveyor rollers 13, or a new coil can be introduced into an empty holding apparatus 2 via the conveyor rollers 13.

On the other hand, the coil 1 can also be lifted only slightly in the holding apparatus 2. In that case, the coil rests on the rollers 11 and can be rotated on these without scraping against the base element 7. The steel tape 1*a* can be guided by support pulleys 14 in FIG. 1 and 2 during withdrawal from the coil 1 and can be dispensed through a slot 15 in the edge 5.

In FIG. 1 and 2, a bracket 31 is mounted in the region of each corner of the base element 7. The brackets 31 support the coil 1 from outside and prevent the steel tape 1a from slipping laterally behind the rollers 11 and jamming there. Furthermore, the brackets 31 stiffen the entire arrangement by connecting with the base and the edge 5 of the base element 7.

FIG. 4a to 4d show a holding apparatus 2a which is distinguished by a particularly low weight in conjunction with high rigidity and stability. For this purpose, the base element provided for holding the coil is reduced to tension belts 28, which are fastened to a frame 27, which is preferably bent or welded into a square shape from a rectangular tubular section. These tension belts 28, which in particular are thin metal belts and, for stability reasons, are mounted in the region of the corner of the frame 27, preferably on its surface, hold the coil 1 (not shown here) by means of support elements 29 in the form of U-profiles and a coil support disk 26. The support elements 29 (FIG. 4b) allow the coil 1 to be supported in a level position on the slightly sagging tension belts 28, owing to its level surface 36 and the underneath 37 (dashed line in FIG. 4b) which corresponds to the sag in the tension belts 28 and is located between the limbs of the U-section. The support elements 29 inverted over the tension belts 28 thus also ensure uniform distribution of the coil weight.

Figure 4C:
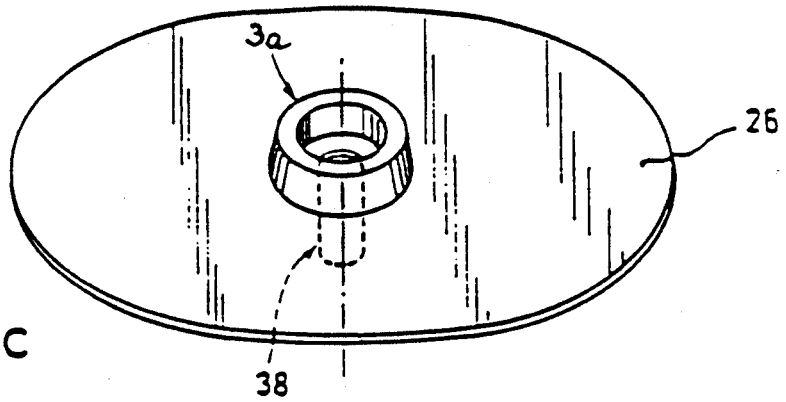
FIG. 4*a*, 4*b*, 4*c* and 4*d* show an exploded view of a variant of the process according to the invention, having tension belts, support elements, a coil support disk and a tape clamping apparatus.
Figure 4B:
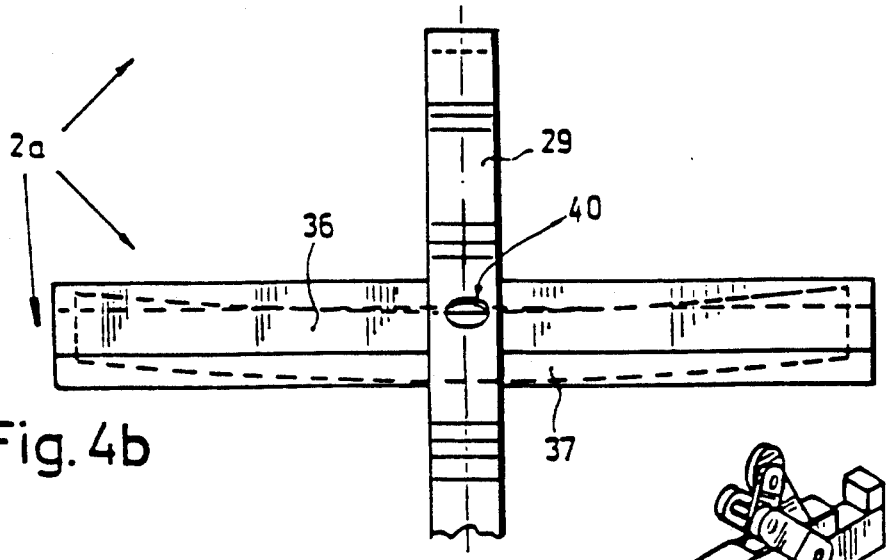

On the support element 29, the coil 1 comes to rest on a coil support disk 26 (FIG. 4c). The coil support disk 26 is preferably a thin sheet-metal disk which has in its center a round shaped part as centering means 3a. With its roll-like edge above the disk 26, this shaped part 3a engages the internal diameter of the coil 1; underneath the disk, it has a bush 38 which here extends through corresponding orifices 39 and 40 into tension belts 28 and support elements 29 and serves for holding a spindle 41 which is provided in handling section 9 for centering the coil 1, for example during the unwind process (cf. FIG. 1).

Figure 4D:
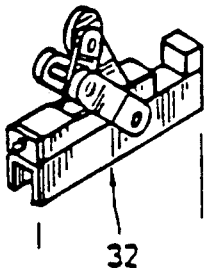
Figure 4A:
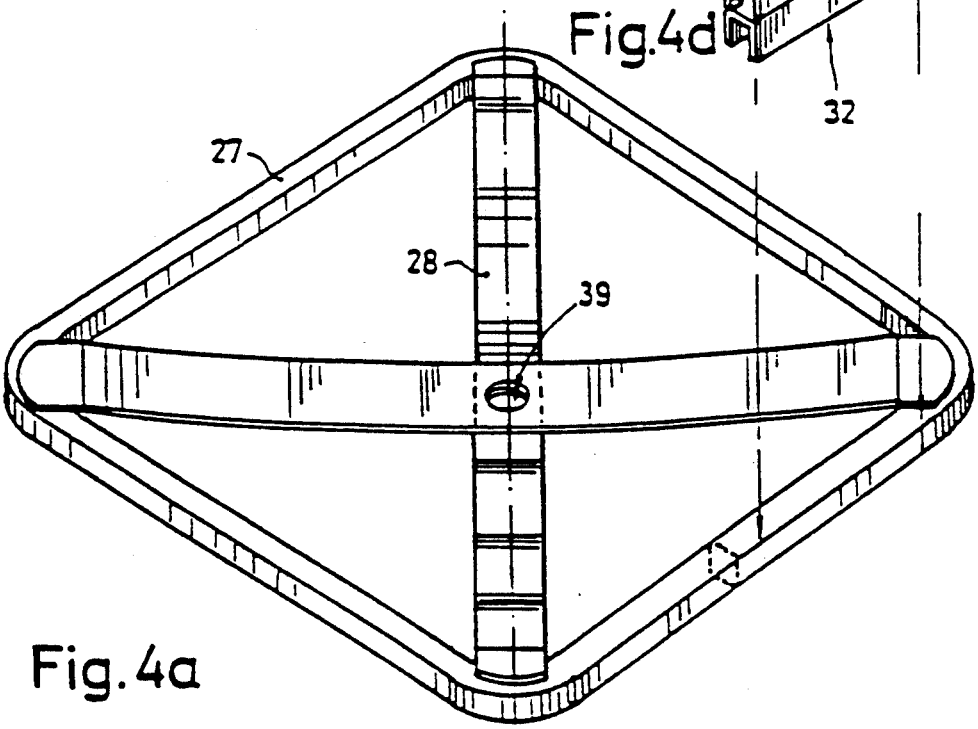

FIG. 4d shows a perspective view of a tape clamping apparatus 32. It is located with a rail 43 on the frame 27 and is hinged to said frame by means of two levers 42 (see FIG. 10a).

Figure 5:
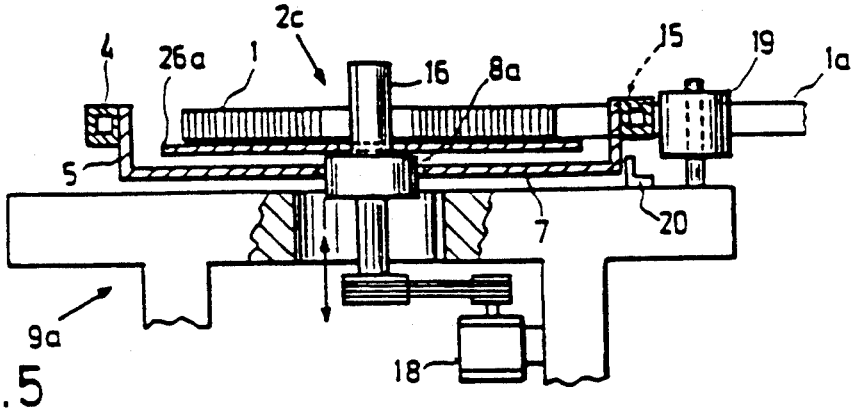
FIG. 5 shows a variant of a holding apparatus and of a handling station.

FIG. 5 shows a handling station 9a having a central spindle 16 which can be passed through an orifice 8a in the center of the base element 7. The spindle 16 is provided with a shoulder which lifts a coil support disk 26a on which the coil 1 is supported. As shown schematically, the spindle 16 can be driven by a motor 18 with the aid of which withdrawal of the steel tape 1a from the coil 1 can be accelerated or—by driving in the opposite direction—braked, depending on the application. As shown schematically in FIG. 5, the support disk 26a or the coil 1 is lifted from base element 7 at station 9a only to such an extent that, when the steel tape la is withdrawn, there is no longer any contact with the base. The holding apparatus 2c is thus relieved of all forces which may occur during unwinding or withdrawal of the steel tape 1a. Furthermore, to relieve the edge 5 from lateral support forces, a pair of pulleys 19, which is shown schematically and by means of which the steel tape 1a is guided, is provided at station 9a.

The spindle 16 can be lifted by a lifting apparatus (not shown) in the manner shown in FIG. 5, in order to permit the unwind operation. By lowering the spindle 16, it can be completely removed from the orifice 8a in the base element 7, and disk 26a and coil 1 can once again be placed on base element 7.

In the embodiment in FIG. 5, the edge 5 is welded to base element 7. A circumferential tubular profile is welded to the edge 5, as a stiffening arrangement 4. By means of a retaining arrangement 20, the holding apparatus 2c is supported laterally at the edge during unwinding.

Figure 6:
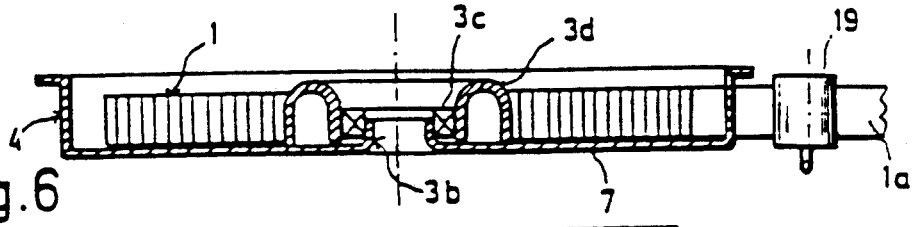
FIG. 6 shows another variant of a holding apparatus having an integrated centering means.

FIG. 6 shows another embodiment, in which a deep-drawn centering ring 3b is provided in the center of base element 7, for supporting and holding coil 1 in a centered position. The centering ring 3b is surrounded by a bearing 3c on which a ring part 3d is fastened. The ring part 3d engages the orifice of coil 1 and centers the latter over a centering spindle of the handling station (not shown) during unwinding of the steel tape 1a.

Figure 7:
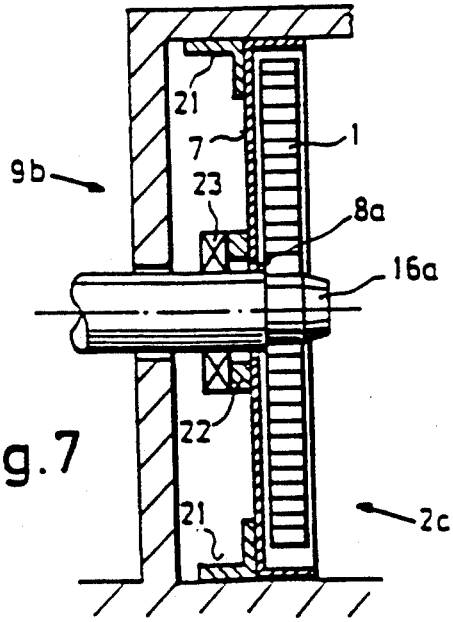
FIG. 7 shows a handling station for vertical storage of a coil.

FIG. 7 shows an embodiment having a handling station 9b possessing a horizontal spindle 16a. A stop 21 is provided on the handling station 9b. In addition, the spindle 16a carries a disk-shaped stop 22, which is fastened to a bearing 23 in such a way that it can move relative to the spindle 16a.

In FIG. 7, the holding apparatus 2c is pushed into the handling station 9b until the base element 7 rests against the stops 21 and 22. The spindle 16a passes through the orifice 8a in base element 7 and, with its conical front section, picks up coil 1. Thus, as in the embodiment according to FIG. 5, base element 7 is completely relieved of the weight of the coil 1, which is pushed onto spindle 16a ready for unwinding. Here, coil 1 need not be taken out or lifted out of the holding apparatus 2c by any auxiliary means. Transfer or acceptance of coil 1 takes place simply as a result of the spindle 16a passing into the orifice 8a in base element 7. In the same way, the coil 1 can be I "transferred" again to the holding apparatus 2c by withdrawing the spindle 16a. To prevent a coil 1, for example a partially used one, from falling down, it is possible to provide suitable centering means in the holding apparatus 2c, which means need not be described here in more detail.

Figure 8:
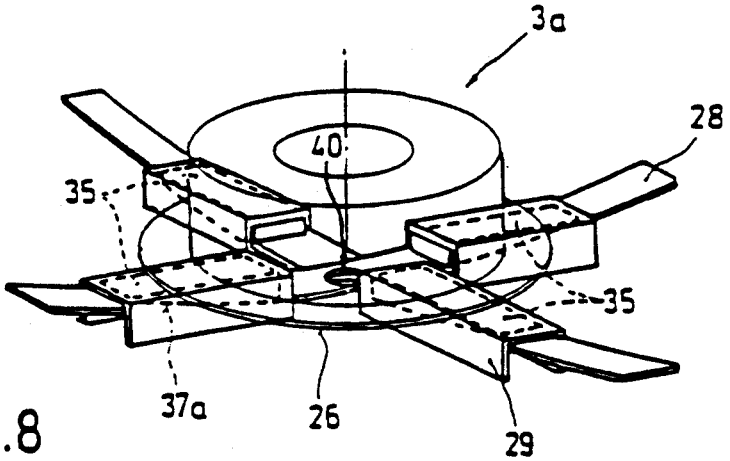
FIG. 8 shows a detail of the variant shown in FIG. 4*a* to 4*c*.

FIG. 8 shows a detail of the variants, shown in FIG. 1a to 4c, of a holding and unwinding apparatus 2a having tension belts 28, support elements 29 and a coil support disk 26 with centering means 3a. The support elements 29, which are inverted over the tension belts 28, cross in the center, leaving an orifice 40 (cf. FIG. 4b). In order to form a level support surface for the support disk 26, four insert parts 35 are provided here, said parts on the one hand being fitted between the U-section of the support elements 29 and on the other hand having their underneath 37a matched to the sag of the tension belts 28 (also see FIG. 9).

Instead of four identical insert parts 35, the support elements 29 themselves may be formed in this manner, as already indicated above.

Figure 9:
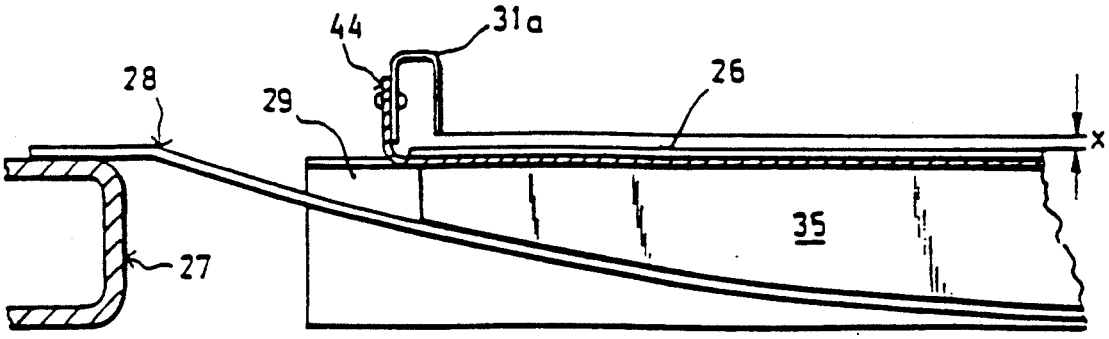
FIG. 9 shows a detailed section of the variant of FIG. 4*a* to 4*c*, having a securing bracket.

FIG. 9 shows a securing bracket 31a, which is fastened to bent-up projections 44 of the support elements 29. This securing bracket 31a is of interest, particularly in the variant of the holding and unwinding apparatus 2a shown, for preventing coils, which by virtue of the properties of their material tend to spring up, from falling out so that their outer tape windings pass beyond the coil support disk 26. The bracket 31a is located between disk 26 and cassette frame 27. For stability reasons, this securing bracket 31a is curved in the form of a U-section in the manner shown, although a simple bent embodiment is also possible. The securing bracket 31a may alternatively be fastened to the cassette frame 27.

In FIG. 9, the coil support disk 26 extends slightly below the bent-back securing bracket 31*a*, a distance x being present between disk 26 and securing bracket 31*a*. This distance x thus defines the maximum possible lifting height for the coil. For unwinding the coil tape, whose width is not limited by any component dimensions, a slot or an open gap must be provided in this securing bracket 31*a* for pulling through the tape.

Figure 10A:
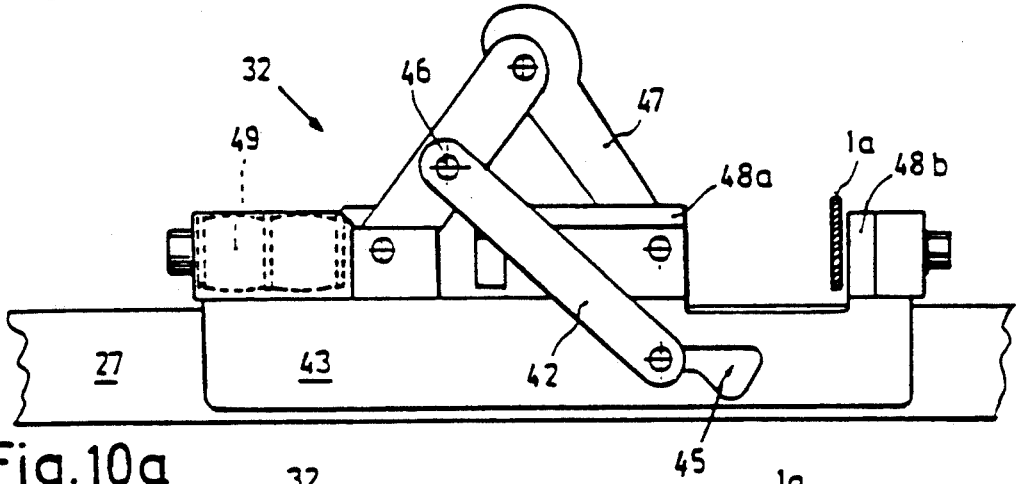
FIG. 10*a*, 10*b* and 10*c* show a tape clamping apparatus.
Figure 10B:
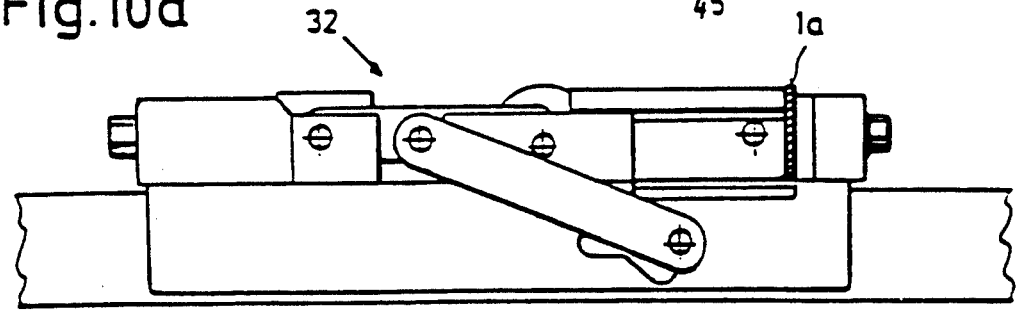
Figure 10C:
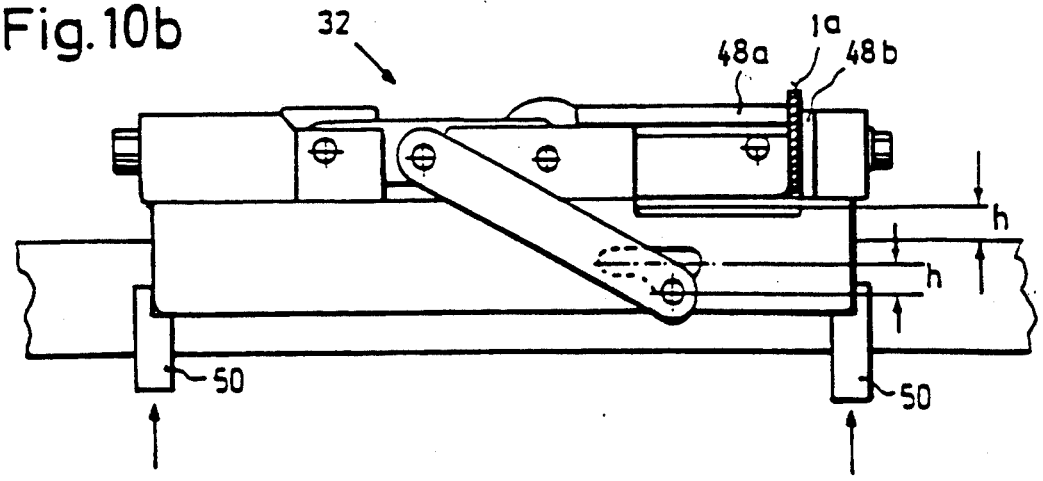

FIG. 10*a* to 10*c* show the mode of operation of a tape clamping apparatus 32 which, corresponding to FIG. 4*d*, is arranged on the cassette frame 27 or, in another embodiment, on the stiffening arrangement 4 (for example FIG. 5). The U-shaped rail 43 is displaceably mounted on the frame 27. The profile of the rail 43 is determined by the frame 27 or the stiffening arrangement 4, since the rail 43 is intended to slide thereon. On the two sides of rail 43, levers 42 are hinged, at one of their ends, to frame 27 through an orifice 45 in the rail 43. At their other end, they are mounted at the fulcrum 46 of a toggle lever 47. If the two levers 42 (only a single lever 42 may also be provided) is lowered toward the frame 27, the tape clamping apparatus 32 on the frame 27 is moved a distance determined by the orifice 45 and, on the other hand, a clamping jaw 48*a* is moved, by means of toggle lever 47, toward a second clamping jaw 48*b* located on the rail 43. In the overstretched position of the toggle lever 47, the coil tape 1*a* is thus kept clamped with sufficient force by the tension of an elastomer spring package 49.

The orifice 45 has an extension on one side so that, when the tape clamp 32 is closed and tape 1*a* is clamped, for example, brackets 50 which engage from below and whose movement is correlated with the lifting of the coil also lift the tape clamp 32 on the frame 27. These brackets 50 are expediently connected to the support rails 6*a* for the frame (cf. FIG. 12).

Figure 11A:
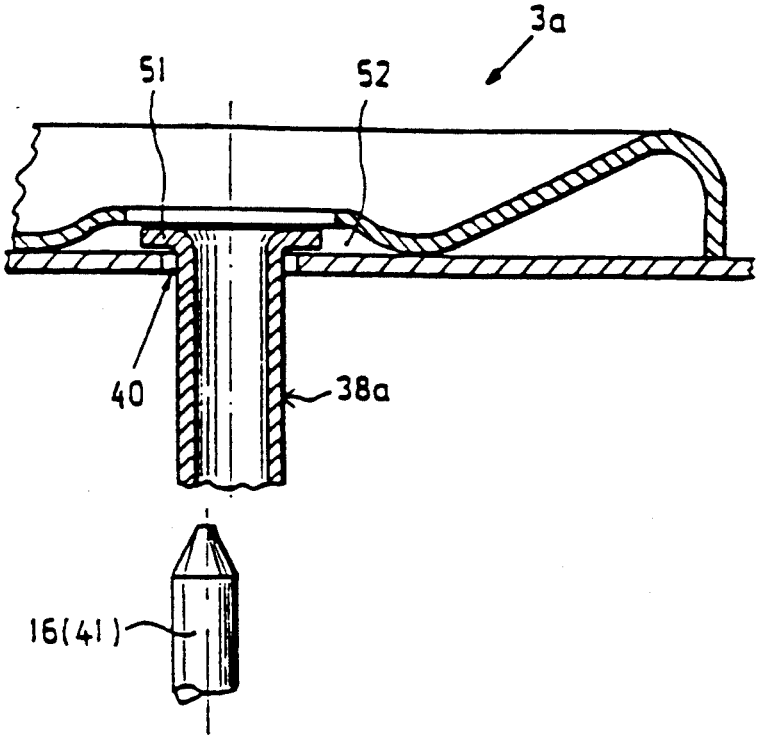
FIG. 11*a* and 11*b* show variants of a radially displaceable centering means.
Figure 11B:
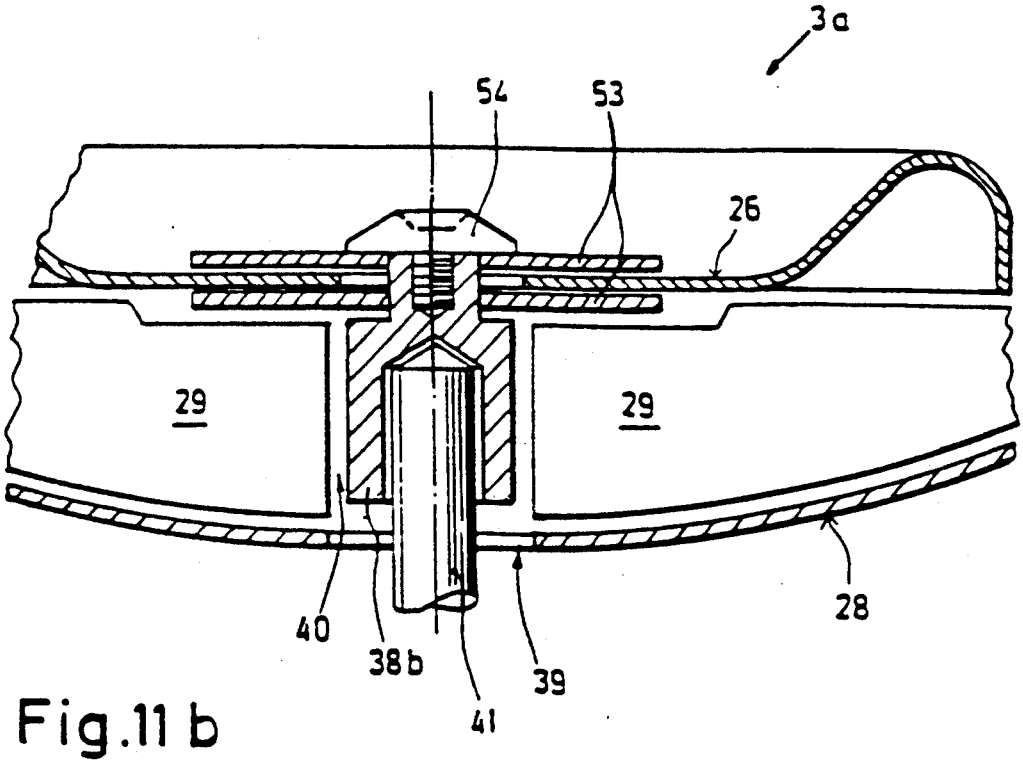

FIG. 11*a* and 11*b* show two possibilities for a radially displaceable centering means. This permits easy insertion of a spindle 41 or 16 where the coil or the coil support disk 26 is not very precisely centered. In FIG. 11*a*, the bush 38*a*, which is provided for holding the spindle 16 (or 41), is equipped for this purpose with a ring flange 51 which is held, so that it is radially displaceable, in a gap between coil holding disk 26 and the roll-like edge piece of the centering means 3*a*. For this reason, the internal diameter of the coil support disk 26 is slightly greater than the external diameter of the bush 38*a* and thus determines the latitude possible for insertion of the spindle 16 or 41. At the same time, it is of course also necessary for the orifices 40 and 39 in support element 29 and tension belt 28 to be correspondingly large.

Another possibility is shown in FIG. 11*b*, in which the bush 38*b* carries two washers 53 toward the coil, between which washers the coil support disk 26 is located. A screw 54 connects these components to one another in such a way that, in the case of slightly off-center mounting on, or insertion in, a spindle 41, the bush 38*b* is radially displaceable within the latitude determined by the internal diameter of the coil support disk 26 and the orifices 40 and 39.

Figure 12:
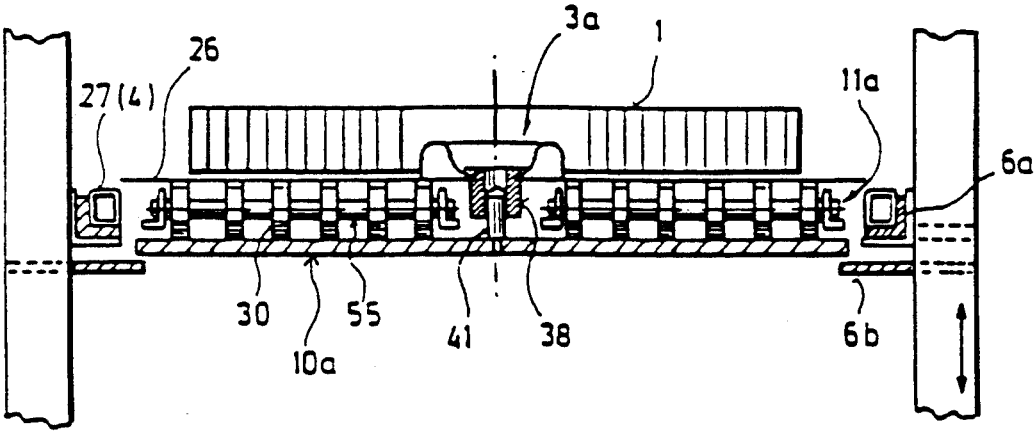
FIG. 12 shows a raised coil in a handling station and FIG. 13 shows a storage rack for coil cassettes.

FIG. 12 merely shows the principle of a coil 1, which can be lifted by means of a series of disks 11*a*, on its support disk 26 having a spindle 41 inserted into the bush 38 of the centering means 3*a*. For this purpose, a table 10*a* with its pulleys 11*a* and its spindle 41 is lifted in the same manner, by means of suitably mounted rails 6*a* and 6*b* which are adjustable in height with or in their holder, through the orifices provided in base element 7 (which is not shown here in any of its possible embodiments), and the frame 27 is also lifted. The brackets 50 shown in FIG. 10*c*, for lifting the tape clamping apparatus 32, would then have to be mounted on the rail 6*a*. In contrast to FIG. 1 to 3, the disks 11*a* in this case are not cylindrical rollers but individual disks 30 which are independently rotatable about a common axle 55. This permits uniform unwinding of the coil, depending on the different rotational speeds. As stated above, conical rollers will also be possible instead of this solution employing independently movable disks 30, but this would be a more complicated solution owing to the overhung mounting required.

Figure 13:
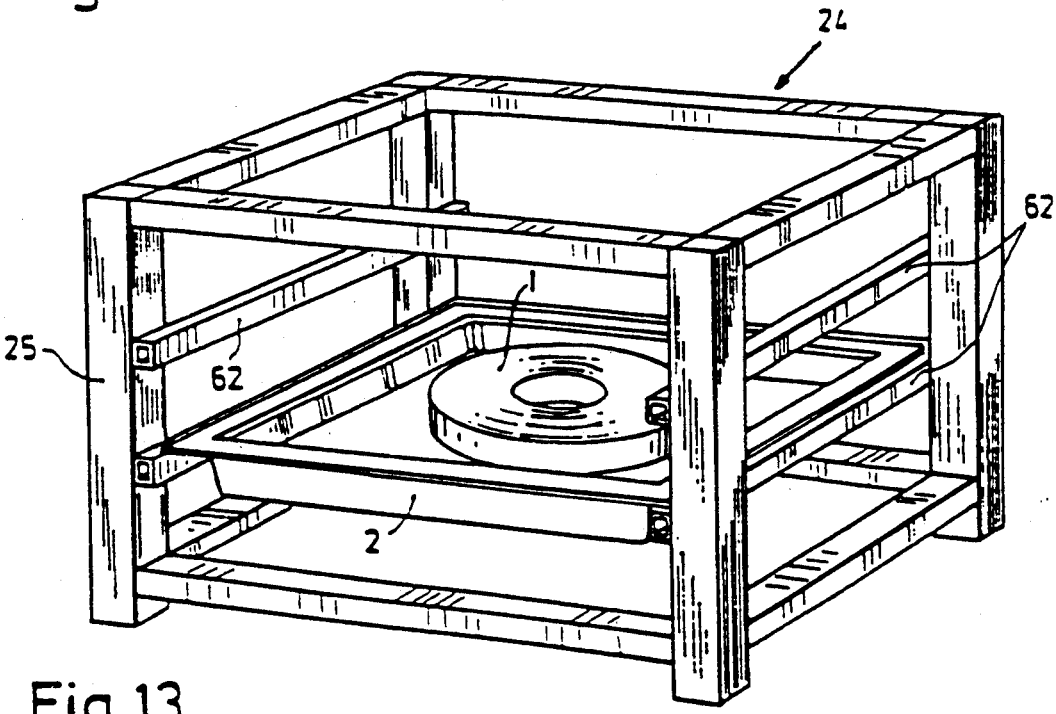

FIG. 13 shows a storage rack 24 having a frame 25 and rails 62. A support apparatus 2 can be placed on each pair of rails 62. Because of their rectangular shape, the holding apparatus 2 can be inserted into the storage rack 24 or pulled out of the storage rack 24 in the manner of a drawer. However, the holding apparatus 2 can also be advantageously manipulated by a method in which, for example, the holding apparatus 2 in the storage rack 24 is first slightly raised, for example by a support arm, and then pulled out virtually without friction. Because of the advantageous shape of the holding apparatus 2, a large number of coils can be stored in a small space and in such a way that they are easy to manipulate, and a wide spectrum of coil diameters and tape widths can be covered with a standard size of the storage rack or of the holding apparatus.

What is claimed is:

1. Apparatus for holding and unwinding a coil of an elongated material, comprising a base element having a trough-like shape for holding the coil, said base element having a geometrical central axis and being open at its top to form an upper edge region;

a stiffening arrangement being provided at least at said edge region; and at least one centering means for centering said coil within said base element;

wherein said centering means is radially displaceably secured for aligning it with the center of said coil.

2. Apparatus as claimed in claim 1, wherein said centering means comprises at least one upwardly protruding member to extend through the center of said coil.

3. Apparatus as claimed in claim 2, wherein said member protrudes from said base element.

4. Apparatus as claimed in claim 2, further comprising disk-like coil support means within said base element, said member protruding from said coil support means.

5. Apparatus as claimed in claim 1, wherein said centering means is rotatably mounted for holding said coil during unwinding.

6. Apparatus as claimed in claim 1, wherein said centering means comprise a spindle, said base element comprising a central opening for allowing passage of said spindle from below.

7. Apparatus as claimed in claim 1, said base element being of sheet material and being integrally formed with said centering means.

8. Apparatus for holding and unwinding a coil of an elongated material, comprising a base element for holding the coil, said base element having a geometrical central axis being open at its top to form an upper edge region, wherein said base element comprises means forming at least one tension means having a certain sag to form a trough-like shape; and a stiffening arrangement being provided at least at said edge region.

9. Apparatus as claimed in claim 8, further comprising means for limiting expansion of said coil of said elongated material.

10. Apparatus as claimed in claim 9, wherein said coil has an outer circumference, and said limiting means comprise bracket means extending so as to engage said outer circumference of said coil upon expansion of said coil.

11. Apparatus as claimed in claim 10, wherein said bracket means extend at least over a portion of said outer circumference.

12. Apparatus as claimed in claim 10, wherein said bracket means includes a slot for allowing passage of said elongated material for unwinding.

13. Apparatus as claimed in claim 9, wherein said elongated material is a tape-like material and said limiting means comprise tape clamping means for clamping an end of said tape-like material that projects from said coil.

14. Apparatus as claimed in claim 13, wherein said tape clamping means are mounted on said stiffening arrangement.

15. Apparatus as claimed in claim 13, further comprising disk-like coil support means within said base element, said tape clamping means are mounted on said base element.

16. Apparatus as claimed in claim 8, wherein said base element is rectangular when seen in plan view and thus defines four corners.

17. Apparatus as claimed in claim 16, wherein said base element comprises means forming two tension belts, each extending in diagonal direction and each being fastened at two ends in a region of two opposite said corners.

18. Apparatus as claimed in claim 8, wherein said stiffening arrangement comprises a circumferentially and upwardly extending edge.

19. Apparatus as claimed in claim 8, wherein said stiffening arrangement comprises frame means on said base element.

20. Apparatus as claimed in claim 8, further comprising slot forming means within said edge region of said stiffening arrangement for allowing passage of said elongated material when being unwound from said coil.

21. Apparatus as claimed in claim 8, wherein said base element comprises means forming two tension belts, each extending in diagonal direction of said base element.

22. Apparatus as claimed in claim 8, wherein said stiffening arrangement comprises a frame defining a circumference, and said tension belt forming means has ends which are fastened on opposite sides of said frame.

23. Apparatus as claimed in claim 22, wherein the ends of said tension belt forming means are fastened to the upper side of said frame.

24. Apparatus as claimed in claim 8, wherein said tension belt forming means comprise at least one strip of thin metal.

25. Apparatus as claimed in claim 8, further comprising at least one support means on said tension belt forming means to level its upper surface.

26. Apparatus as claimed in claim 25, wherein said tension belt forming means comprises at least two arms extending from said central axis into opposite directions, said support means comprising at least one support element for each of said arms.

27. Apparatus as claimed in claim 26, wherein said support element has an U-Profile whose base is at the top and which is inverted over one of said arms.

28. Apparatus as claimed in claim 27, wherein said base element has a lower surface that is matched to the sag of said tension belt forming means.

29. Apparatus as claimed in claim 27, further comprising insert wedge means interposed between said base of the U-shaped support element and said tension belt forming means, and being matched to the sag of the tension belt forming means.

30. Apparatus as claimed in claim 8, wherein said base element and said stiffening arrangement are integrally formed, the base element being of sheet material.

31. Apparatus for holding and unwinding a coil of an elongated material, comprising:

a base element having a trough-like shape for holding the coil, said base element having a geometrical central axis and being open at its top to form an upper edge region;

a stiffening arrangement at least being provided at said edge region;

further comprising at least three rotatable support means distributed in an angularly equidistant manner with respect to said central axis, and being arranged below said base element, the base element forming at least three openings to allow passage of said rotatable support elements from below for lifting and unwinding said coil.

32. Apparatus as claimed in claim 31, wherein said rotatable support means comprises radially extending roller means.

33. Apparatus as claimed in claim 31, wherein said roller means are conical, the larger diameter being situated radially outwardly.

34. Apparatus for holding and unwinding a coil of an elongated material having an axis of rotation, the apparatus comprising:

holding means extending substantially within a horizontal plane; and at least three coil support means rotatably mounted on said holding means and being distributed in an angularly equidistant manner with respect to said axis of rotation, each of said coil support means comprising a series of disks having substantially equal diameters which are rotatable about an axis extending in a plane that intersects the axis of rotation of said coil.

* * * * *